US005657618A

United States Patent [19]

Dall'Omo et al.

[11] Patent Number: 5,657,618

[45] Date of Patent: Aug. 19, 1997

[54] DEVICE FOR THE SELECTION OF LARGE LOOSE REAMS

[75] Inventors: Davide Dall'Omo, Bologna; Claudio Pederzani, Anzola Emilia, both of Italy

[73] Assignee: Wrapmatic S.p.A., Bologna, Italy

[21] Appl. No.: 501,553

[22] Filed: Jul. 12, 1995

[30] Foreign Application Priority Data

Jul. 29, 1994 [IT] Italy ..... B094A0371

[51] Int. Cl.[6] ..... B65B 5/06; B65B 35/30

[52] U.S. Cl. ..... 53/504; 53/531; 414/796; 414/797.3

[58] Field of Search ..... 53/493, 504, 531, 53/540; 414/795.9, 796, 796.2, 796.8, 796.9, 796.3, 796.4, 797.3

[56] References Cited

U.S. PATENT DOCUMENTS

| | | | |
|---|---|---|---|
| 2,688,414 | 9/1954 | Haas | 414/796.8 X |
| 3,176,859 | 4/1965 | Prager . | |
| 4,551,053 | 11/1985 | Ishibashi | 414/796 |
| 4,620,827 | 11/1986 | Sameshima et al. | 414/796.8 X |
| 4,623,292 | 11/1986 | Suzuki et al. | 414/796.8 X |
| 4,861,227 | 8/1989 | Cinotti | 414/796 X |
| 5,244,340 | 9/1993 | Pizzi et al. . | |

FOREIGN PATENT DOCUMENTS

| | | |
|---|---|---|
| 423065 | 4/1991 | European Pat. Off. . |
| 61-081340 | 4/1986 | Japan . |

*Primary Examiner*—Linda Johnson

*Attorney, Agent, or Firm*—Fay, Sharpe, Beall, Fagan, Minnich & McKee

[57] ABSTRACT

The selection device includes a sensor unit which checks the flatness of the free surface of a sheet pack at an edge, and which moves vertically away from and into contact with the free surface of the pack; the sensor unit extends along an axis transversal to a direction of feed and operates a blade which defines the ream and is opposite and attached to the said sensor unit, moving with the unit near to the edge, and may be positioned parallel to the free surface of the pack; drive means are envisaged for the blade, to move it from a position away from the edge until it makes contact with the ream, at which point the blade penetrates the pack, and a position in which it defines a gap between the ream and the pack, in which the blade is turned about the transversal axis through an angle sufficient to allow the transfer means to penetrate the ream.

20 Claims, 5 Drawing Sheets

4b
4i
Z
4
F2
13
12
26
21
29
31
50
16
7
17
3
III
15
17
27
14
30
20
5
25
11
23
III
F
FC1
6r
18
6
16r
16v
1a
1
16n
8
P
F1

DEVICE FOR THE SELECTION OF LARGE LOOSE REAMS

BACKGROUND OF THE INVENTION

The present invention relates to a device for the selection of large loose reams.

In the case of large reams, that is to say, the reams used for sketches, drawings, printed copies, etc., a significant problem is ream selection in the machines designed to package them into separate packs.

The sheets to be fed to the packaging machines, arriving from the cutting machine which produces them, are placed on a pallet in the form of a pack; the pallet is then positioned on a lift which gradually raises it automatically as an operator above selects and removes a pack of sheets destined to form a ream, so that the sheets are always piled to the same height.

The use of an instrument similar to a gauge is normally envisaged for the selection of the ream from the pack of sheets, the fixed measuring arm being an element similar to a stop, and the movable arm being a blade which may be inserted between one sheet and the next. The operator determines the thickness of the ream to be obtained in accordance with the number of sheets of which it must consist and their thickness, then rests the gauge stop on the top sheet, allowing it to run over this sheet until the blade is inserted between two sheets, to separate the selected ream above from the remaining pack of sheets below. The edge of the selected ream is then raised and it is pushed towards the packaging machine downstream. In another, similar case, the machine which prepares the packs of sheets from which the reams are obtained counts the sheets and inserts a marker between one sheet and the next to define a ream in accordance with a preset number of sheets; the marker is a piece of paper or similar material, usually coloured, which protrudes from the pack of sheets.

The operator must, therefore, lift and push the ream selected (again with the afore-mentioned gauge or, alternatively, automatic selection systems), positioned above the marker, in the direction of the packaging machine.

Selection using automatic systems is extremely precise, although the markers are not always in the same position, due both to varying sheet dimensions and the different machines which prepare the packs. In particular, the manual selection of reams from a pack of sheets using a gauge is, given the production rates of current packaging machinery, the considerable size and weight of the reams, inconvenient and difficult for the operator.

SUMMARY OF THE INVENTION

In order to overcome the disadvantages mentioned above, the Applicant has invented a semi-automatic selector (see patent U.S. Pat. No. 5,244,340), with which the operator continues to use the gauge to select the reams, whilst the transfer of the ream to the packaging machine (being, as indicated, the most tiring stage) is completed by means of a servo-mechanism which uses a pair of horizontal blades, set parallel to one another and close to the edge of the pack of sheets. These blades are vertically adjustable and can penetrate the ream of sheets preselected by the operator. The blades are mounted on a carriage which slides along a horizontal guide, so that they slide parallel to the length of the pack of sheets, penetrating the preselected ream and feeding it to the packaging station. This solution without doubt facilitates part of the operator's work (he/she no longer pushes the selected ream to the packaging station manually), although the selected ream may be damaged, since selected sheets are not always raised to the required level when they encounter the blades in their operating zone. This problem arises due to selection with the gauge, inserted between the two blades, which creates only a small arc along the length of the sheets, due to the limited depth of the gauge itself and the operator's lifting strength; in this case, as the blades penetrate the ream it may still be compact with the rest of the stack of sheets, causing deformation of the sheets in that zone.

A further disadvantage arises from the fact that the geometric configuration of the packs of sheets produced by the cutting machines is not always identical, especially with relation to the edges cut, where selection of the reams is effected, and may lead to the erroneous selection of the quantity of sheets which define a ream.

The aim of the present invention is to eliminate the said disadvantages by creating a device for the selection of reams of sheets which may be fitted to the afore-mentioned type of semi-automatic selectors which are automated, fast, easy to use and reliable for the division of upper reams.

BRIEF DESCRIPTION OF THE DRAWINGS

The technical features of the present invention, in accordance with the said aims, are clearly described in the claims herein and the advantages of the invention are more clearly shown in the detailed description below, with reference to the accompanying drawings which illustrate an embodiment by way of example only, and in which:

DESCRIPTION OF THE PREFERRED EMBODIMENTS

Figure 1:
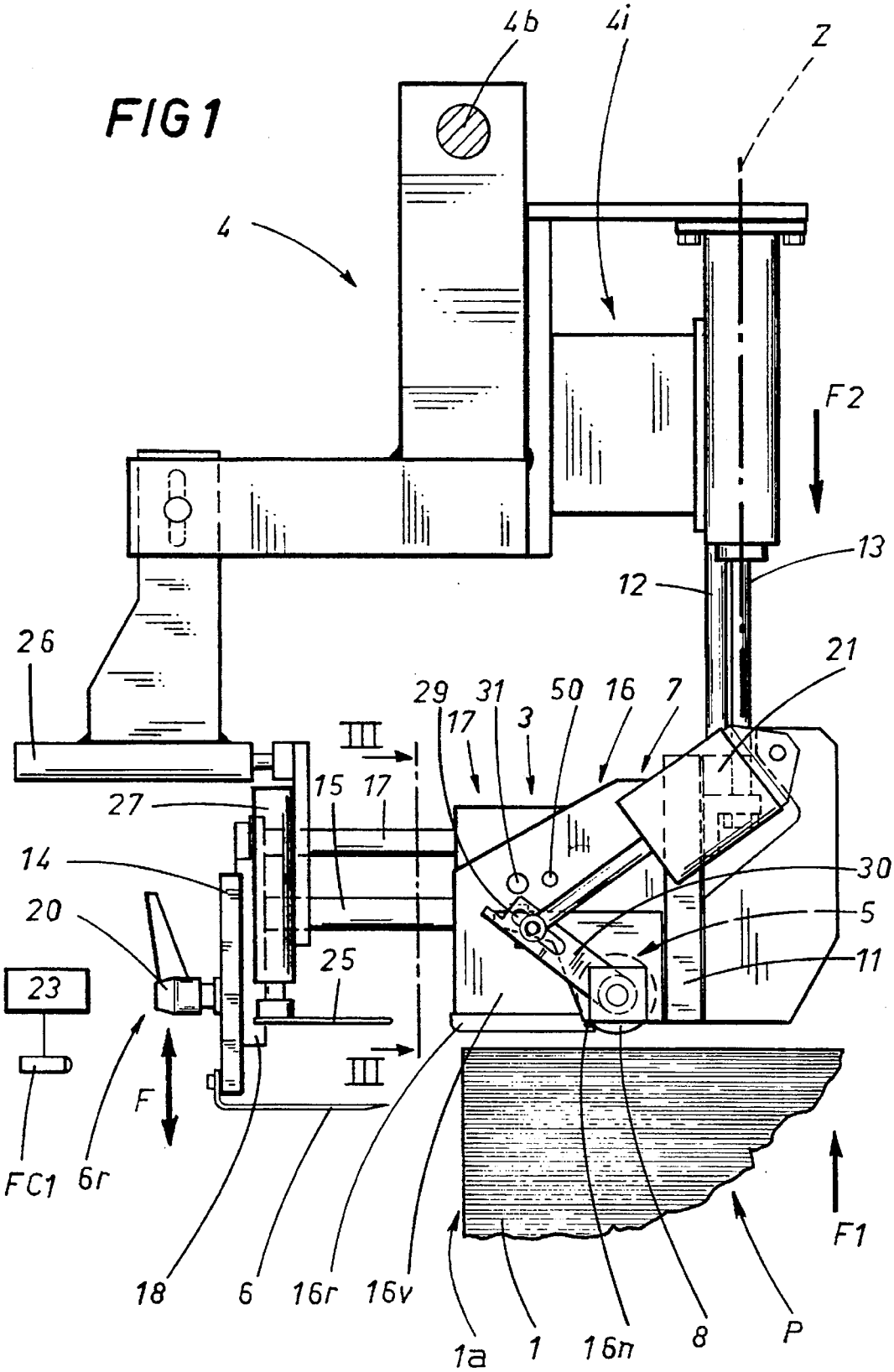
FIG. 1 is a side view of the device for the selection of large loose reams fitted to a ream selection apparatus, with some parts cut away to better view others.
Figure 2:
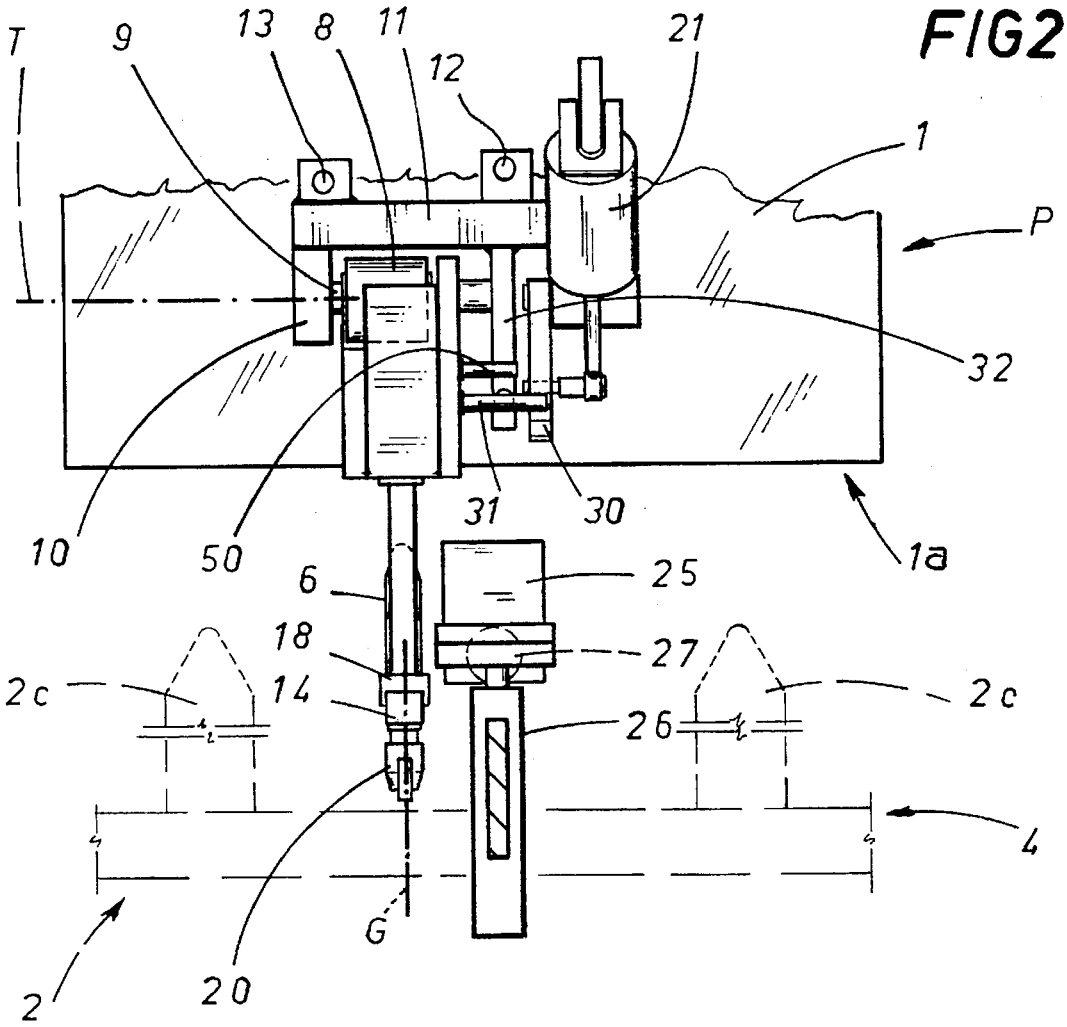
FIG. 2 is a plan view of the selection device illustrated in FIG. 1, with some parts cut away and others shown in cross-section.
Figure 3:
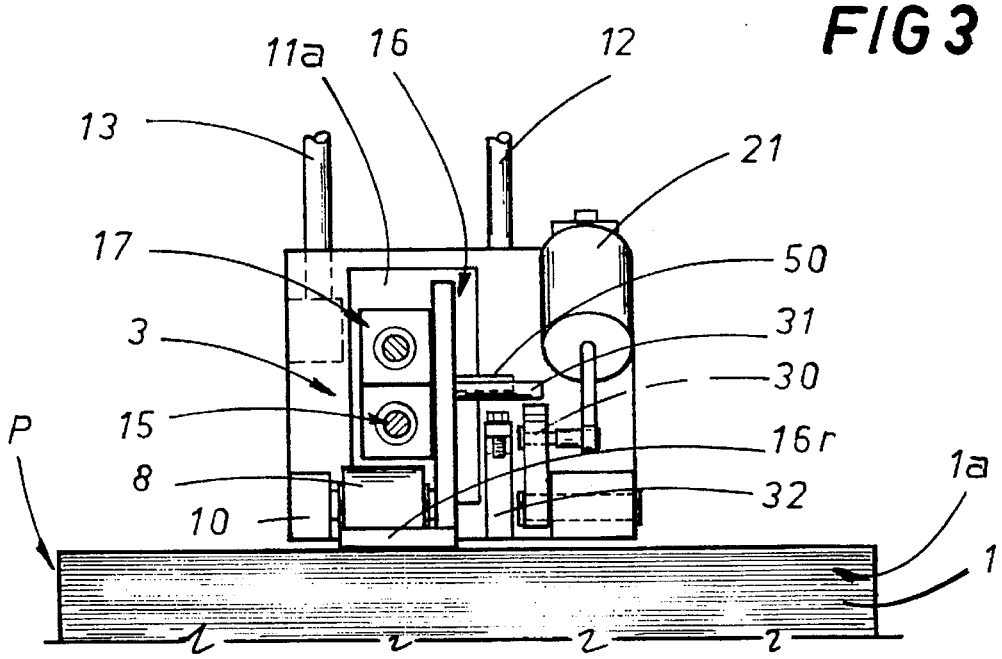
FIG. 3 is a cross-section III—III as shown in FIG. 1.
Figure 7:
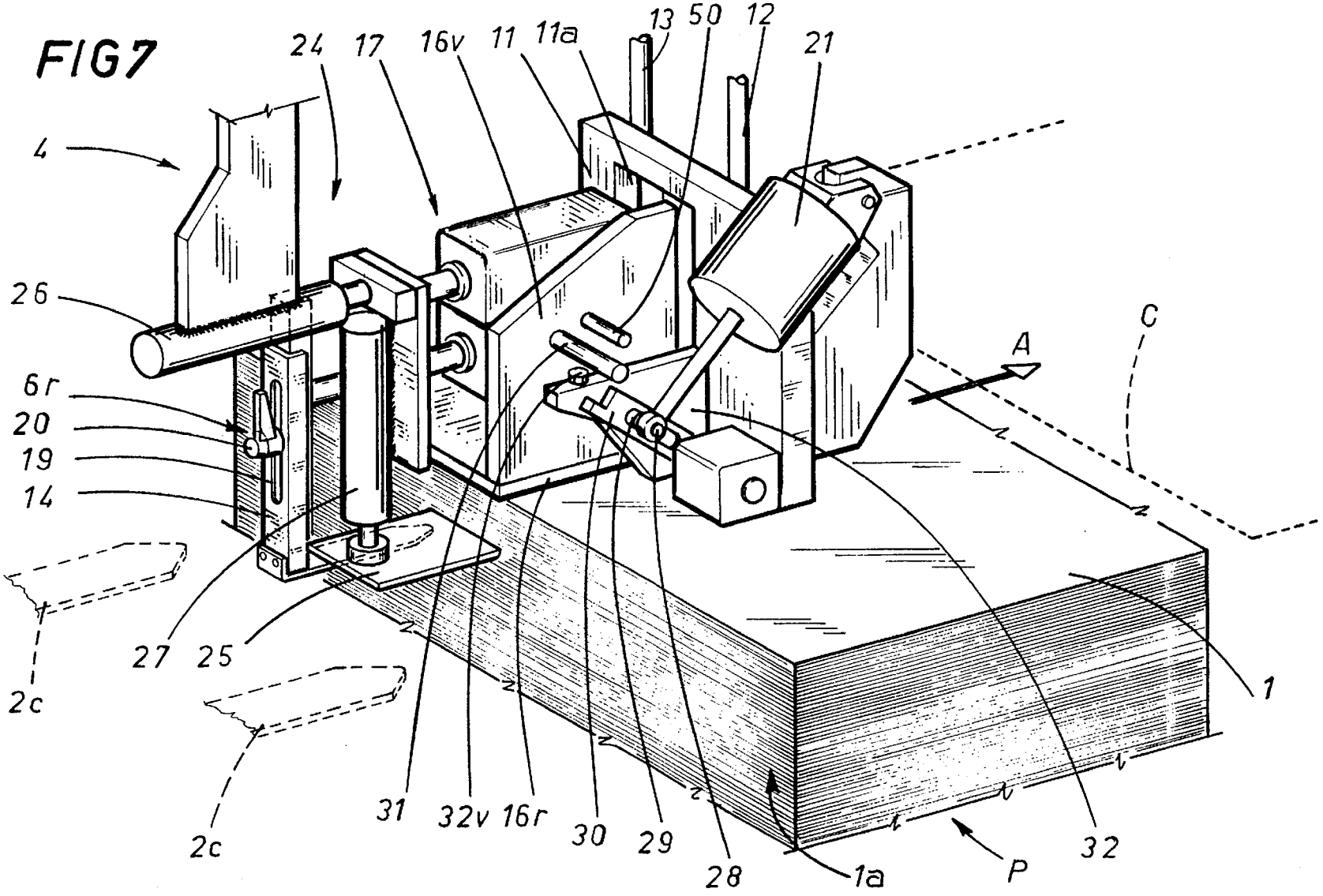
FIG. 7 is a perspective view of the device illustrated in the previous figures, in a position which refers to FIG. 1.

In accordance with the accompanying drawings, and in particular with reference to FIGS. 1, 2 and 7, the device disclosed allows the selection of large loose reams 1 from a stacked pack P of sheets resting on a surface (which is not illustrated) that moves along a vertical axis Z, located upstream of a packaging station C for the said preselected reams (the station is only partially shown, being of a known type).

In FIGS. 2 and 7 the numeral 2 indicates means for the transfer of the ream 1, preselected by selection means 3

(described in more detail later), in the direction of the packaging station C. These transfer means 2, of a known type and only partially illustrated, consist of a pair of horizontal blades 2*c*, mounted on a horizontal carriage 4 and designed to penetrate the sheets between the upper surface of the pack P and the base of the ream 1; the said blades 2*c*, positioned in correspondence with the edge 1*a* of the pre-selected ream 1 opposite that facing the packaging station C, are vertically adjustable (thanks to drive means connected to the carriage, which are not illustrated here) so as to obtain the transfer, by pushing, of the ream 1 in a direction of feed A, that is to say, towards the packaging station C.

The afore-mentioned selection means 3 are located between the pair of blades 2*c* and consist, essentially, of a sensor unit 5 which checks the flatness of the free surface of the sheet pack P, another blade 6 connected to and opposite the sensor unit 5 and drive means 7 for both of the said elements Following the sequence described above (and observing FIGS. 1, 2, 3 and 7), the sensor unit 5 is aligned with the said edge of the ream 1 opposite that facing the packaging station C. It is mounted on a horizontal bar 4*b*, parallel to the horizontal carriage 4, and can move vertically away from and into contact with the free surface of the sheet pack P. More precisely, the sensor unit 5 extends along an axis T transversal to the said direction of feed A. The main element of the sensor unit 5 is a roller 8 which makes contact with the free surface of the sheet pack P, the roller turning freely about a support shaft 9, attached at both ends to corresponding roller-type cages 10 (bearings).

Seats designed to house the shaft 9 may be added to the structure of these cages 10, the diameter of the slot being larger than that of the shaft 9, so as to allow the shaft to rock about an axis parallel to the direction of feed A depending on the flatness of the surface of the sheet pack P: this allows a further check of the surface of the sheet pack P, mainly effected along the width of the sheet pack P.

The cages 10 are, in turn, fixed to a vertical plate 11, in turn attached to a relative vertical guide 12, the top of which is attached to the bar 4*b*; the guide 12 and plate 11 are moved vertically by a corresponding hydraulic piston 13, also housed in a frame attached to the bar 4*b*, which thus moves the roller 8 away from and into contact with the surface of the sheet pack P.

The blade 6 which defines the ream 1 is opposite and attached to the sensor unit 5 (more clearly seen later), and moves with the sensor unit 5 close to the edge 1*a* of the sheet pack P so that it may be positioned parallel to the free surface of the said sheet pack P. More precisely, the blade 6 lies on a horizontal axis G (see FIG. 2) which passes through the centre of the roller 8 support shaft 9 and consists of a flat blade with tapered free end, whilst the other end is attached to a first, vertical rod 14, in turn connected to a second, horizontal rod 15 which is attached to a support cradle 16 in such a way that it may slide along it. The support cradle moves with the shaft 9 so as to position the blade 6 correctly relative to the surface of the sheet pack P checked by the roller 8.

The first, vertical rod 14 is moved by a first horizontal piston 17, also connected to the cradle 16, constituting part of the said drive means 7, and designed to allow the movement of the blade 6 along the length of the sheet pack P. The cradle 16 which supports the blade 6 consists of a vertical wall 16*v* to which the first rod 14 and first piston 17 are connected, and a horizontal surface 16*r* fixed to the wall 16*v* opposite the roller 8, having a wall 16*n* which is angled and set at a tangent to the roller: said wall acts as an extension of the roller 8 when the latter rests on the surface of the sheet pack P in order to determine the positioning of the blade 6.

Moreover, means 6*r* are envisaged for adjustment of the distance between the blade 6 and the roller 8; these means 6*r* move the blade 6 vertically, parallel to the vertical axis Z, bringing it to a distance from the free surface of sheet pack P equivalent to the predefined thickness S of the ream 1.

These adjustment means 6*r* (see FIGS. 1 and 2) consist of the said first vertical rod 14, which supports the blade and is attached in such a way that it mat slide to a third vertical rod 18, fixed to the second horizontal rod 15. A slot 19 is envisaged in the first rod 14, for manual adjustment of the height of the blade 6 with respect to the roller 8, the first rod 14 also housing a handle 20 designed to lock the first rod once engaged in the third vertical rod 18, thus locking the blade 6 in position.

Figure 5:
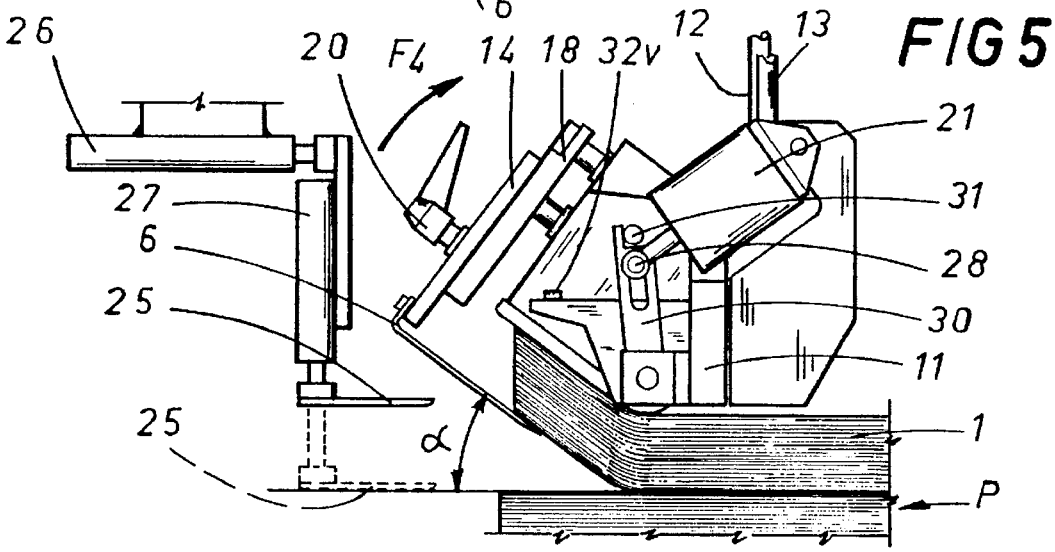
Figure 6:
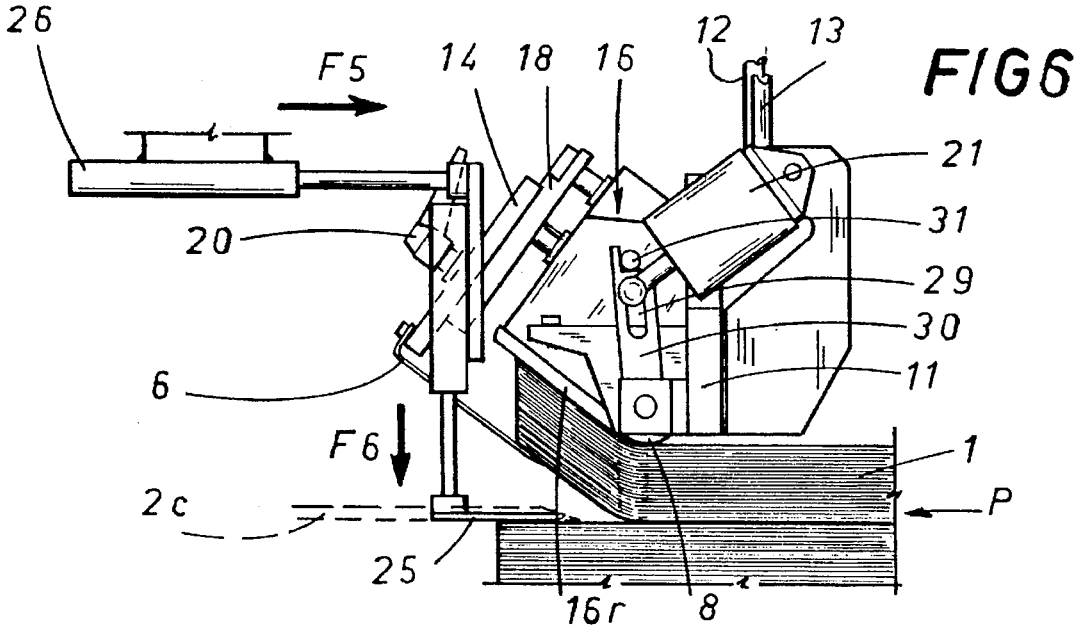
FIG. 6 is a side view with some parts cut away to better view others of the device shown in FIGS. 4 and 5 in a further operating configuration, that is to say, with a lowered sheet pack compacting device.

The drive means 7 envisage not only the said first piston 17, which allows the blade 6 to make contact with and penetrate the ream 1, but also a second piston 21 positioned at the side of the roller 8 and attached, at one end, to the vertical plate 11. The other end of the second piston 21 has a first pin 28 parallel to the shaft 9 and transversally engaged in such a way that it may slide within a slot 29 in a first lever 30. One end of the lever is pivoted to the plate 11, whilst the other end is opposite a second pin 31, again parallel to the shaft 9, fixed to the cradle 16: in this way, when the second piston 21 is operated and raises the first lever 30 towards the plate 11, the end of the first lever 30 intercepts the second pin 31 which, in turn, causes the roller 8, the cradle 16 and so also the blade 6 which has penetrated the ream 1 to turn through an angle $\alpha$ (see FIGS. 5 and 6). In this way a gap is defined between the ream 1 and the remaining sheet pack P, large enough to allow the said horizontal blades 2*c* to penetrate the ream 1. The plate 11 has an open section 11*a* at the roller 8 and cradle 16, in order to allow them to rotate correctly.

Cradle 16 end stops are envisaged in order to obtain stable positioning of the cradle 16 as the sensor unit 5 is raised. These end stops are clearly visible in FIGS. 3 and 7 and consist of a third horizontal pin 50, parallel to the second pin 31, and attached to the cradle 16. When the cradle 16 is moved away from the pack P below, this third pin 50 encounters a fixed horizontal wall 32, attached to the plate 11 and inserted between the first lever 30 and the vertical wall 16*v* of the cradle 16.

This wall 32 also has a vertical screw 32*v*, with adjustable height which, during the downward rotation of the cradle 16, moves into the zone of contact with the third pin 50: in this way it is possible to adjust the position of the end stop for the cradle 16 downstroke by tightening or loosening the screw 32*v*. This position is, of course, always outside the maximum range of the curve of the edge of the sheet pack P and within the acceptable limits for the selection device.

The sensor unit 5 also has means 24 for compacting the sheet pack P beneath the selected ream 1, when the ream edge 1*a* is in its rotated configuration; these means 24 essentially consist of a horizontal shoe 25 positioned beside the blade 6 and supported by a pair of pistons 26 and 27, in turn supported by the said horizontal bar 4*b*, one piston being horizontal and the other vertical, causing the blade to move in the direction of feed A and to move vertically.

All of the sensor unit 5 and blade 6 movements previously described are regulated by means 23 which control the positions assumed by the said elements with respect to the sheet pack P and which operate adjustment and drive means 7 in such a way as to obtain an automatic cycle in the entire device. These control means 23 consist of both photocells of a well-known type, positioned opposite the sheet pack P to be selected (see FIG. 1), and sensors (not illustrated) connected to the various pistons in the device and used to detect the limit positions of the said pistons.

The device thus configured selects reams 1 in the following way, starting from the machine start cycle configuration.

Firstly, the blade 6 is set at a given distance from the roller 8 so as to determine the thickness S of the reams to be selected: the selection is effected by unlocking the handle 20 on the third vertical rod 18, so that the first blade 6 support rod 14 slides along the third rod (see arrow F in FIG. 1) to position the blade 6 at the exact height, being locked in place by relocking the handle 20.

At this point, the sheet pack P is raised (see arrow F1 in FIG. 1) towards the carriage 4 until it covers photocell Fc1 which determines the pack P selection position. Piston 13 is then activated, allowing the entire sensor unit 5, together with the blade 6, to descend until the roller 8 comes into contact with the surface of the sheet pack P (see arrow F2 in FIGS. 1 and 7); to ensure that the roller 8 comes to rest on the surface correctly, the piston 13 always arrives at its lower limit position.

The roller 8 therefore adapts perfectly to the flatness of the surface of the pack P (in particular, to the pack transversal line), thanks to the shaft 9 ability to rock, also adapting the position of the cradle 16 and blade 6 to the geometric configuration of the sheet pack P; the horizontal surface **16*r* of the cradle 16 rests on the surface of the pack P, the former making contact with the roller via the angled wall 16*n***.

Figure 4:
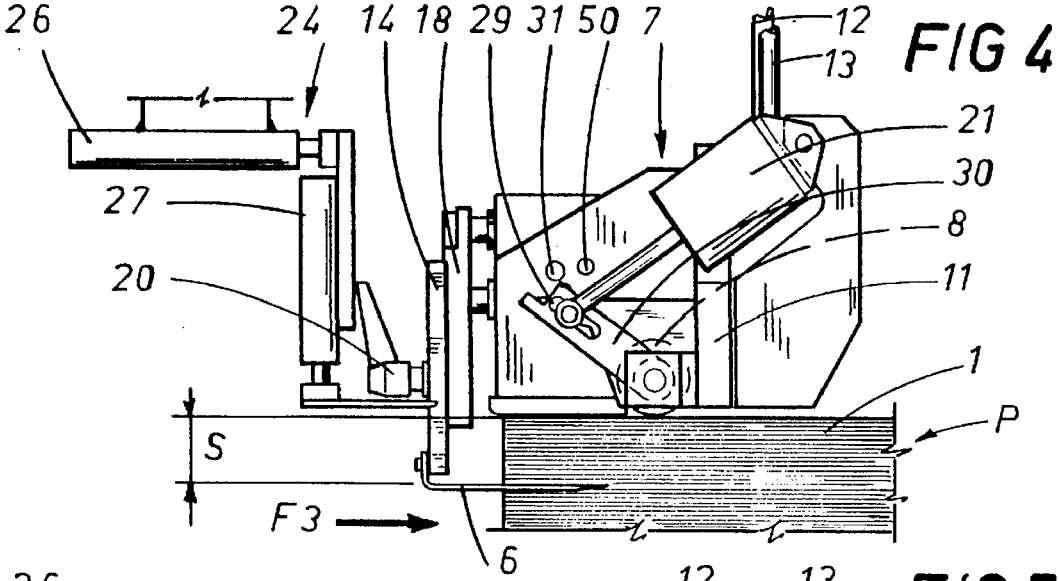
FIGS. 4 and 5 show the selection device illustrated in the previous figures in two different operating configurations, that is to say, having made contact with the pack of sheets and, respectively, in the rotated position for selection of the ream, both being side views, scaled-up with respect to the previous figures.

With the blade 6 in a position perfectly parallel with the sheets of the pack P, the first piston 17 is activated, driving the blade 6 towards and into the pack (see arrow F3 in FIG. 4). When the blade 6 is in this position, the second piston 21 is activated, simultaneously turning the cradle 16 and blade 6, setting them at a fixed angle $\alpha$ to their starting point (see arrow F4 in FIGS. 5 and 6); this lifting motion causes a gap to be created between the selected ream 1 and the remaining the sheet pack P below (again see FIGS. 4 and 5) in order to facilitate the insertion of the pair of transfer blades **2*c***.

To further facilitate the insertion of the pair of transfer blades **2*c*, the compacting shoe 25 is activated. Driven by the pair of pistons 26 and 27 in the directions indicated by arrows F5 and F6 in FIG. 6, the compacting shoe 25 is positioned at the remaining pack P, which is thus gently pressed down to allow insertion of the blades 2*c*. Before the latter push the ream 1 towards the packaging station C, both the shoe 25 and the blade 6 are respectively removed from the pack P and ream 1 and returned to their starting positions, so that the ream 1** may be safely transferred in the direction of feed A.

Upon completion of ream 1 transferral, when the blades **2*c*** have been drawn back and the sheet pack P raised, the device's operating cycle is repeated, following the sequence described above.

Figure 8:
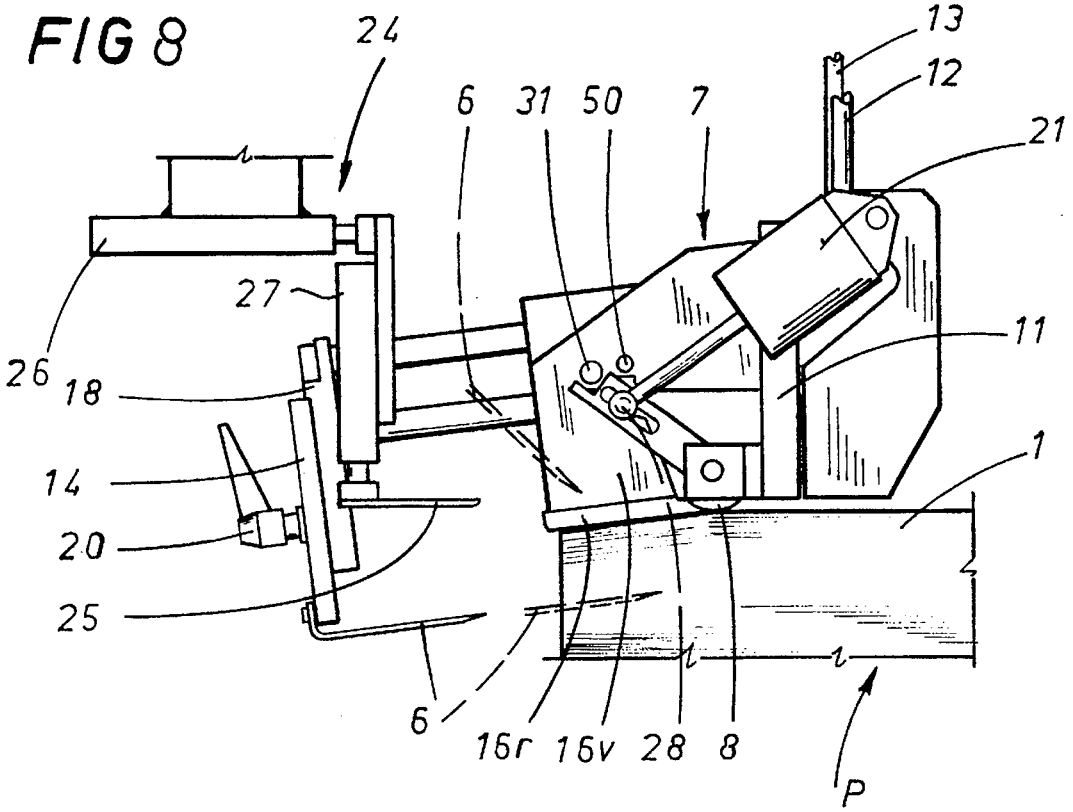
FIGS. 8 and 9 are side views with some parts cut away of the device disclosed as it rests on the pack of sheets, the outer edge of the device angled downwards and upwards respectively.
Figure 9:
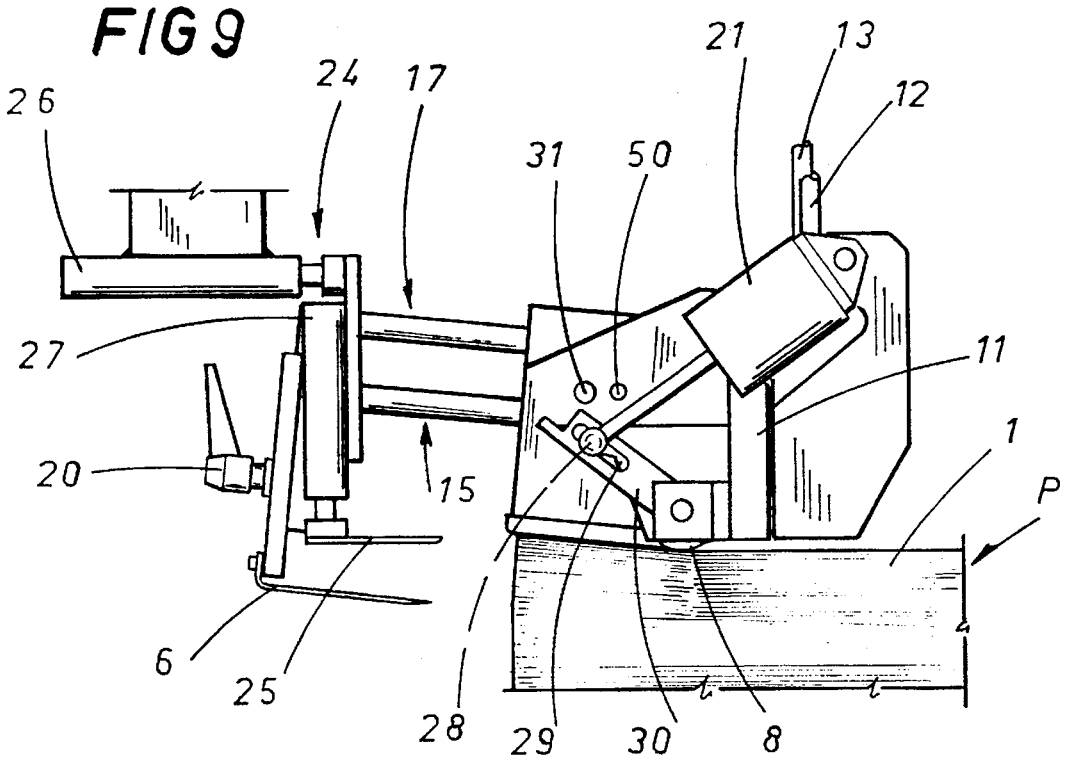

The present device, therefore, achieves the aims described herein thanks to a simple structure with precision movements, and being, above all, safe to use; as is shown in FIGS. 8 and 9, which illustrate a sheet pack with the edge facing, respectively, downwards and upwards. The possibility of checking the flatness of the surface of the sheet pack P, along the edge **1*a* to be turned, by using the roller 8, makes the penetration of the blade 6 safe, since the blade is positioned so that it "copies" the geometric configuration of the sheets of which the ream 1** will consist.

The blade 6 is rotated in accordance with a fixed stroke of the second piston 21, irrespective of the position assumed by the blade (pointing down or up) and also allows increased safety in the insertion of the pair of transfer blades **2*c*: the rotation effected by such a device causes the entire edge of the ream for the entire width of the selected ream to be inverted, irrespective of the ream dimensions. This would not have been possible in selection using a conventional gauge. In this way, the pair of transfer blades 2*c*** may penetrate the sheet pack P unhindered, irrespective of the distance between the said blades and the selection device.

Moreover, given its extreme efficiency and notable precision in selection, this device may also be used to select reams from sheet packs containing ream reference markers: obviously, in this case there may be means for the suction of the ream reference markers, these means being positioned opposite the sheet pack so that they instantly remove the marker when the selected ream is transferred in the direction of the packaging station.

The present invention, thus designed for the said objects, may be subject to numerous variations, all encompassed by the original design concept, and all components may be replaced with technically equivalent parts.

What is claimed:

1. A device for selecting a ream from a stacked pack of sheets and packaging said ream, the device comprising:

a surface for supporting said pack and moving said pack along a vertical axis;

a packaging station, adjacent said surface, for packaging said selected ream;

means for transferring said selected ream in a feed direction from said surface to said packaging station, said means for transferring being vertically adjustable and mounted on a horizontally movable carriage;

means for selecting said ream from said stack, including:

a sensor unit for sensing a free surface of said stack, said sensor unit extending along an axis that is transverse to said feed direction and being vertically movable with respect the free surface of the sheet pack;

a blade, movably connected to said sensor unit, for penetrating said stack and thereby selecting said ream, said blade being mounted for pivotal movement with respect to said transverse axis;

drive means for moving said blade from a horizontal position to a position in contact with and penetrating said stack and to a position in which said blade is at an angle to the horizontal.

2. The device according to claim 1, wherein said sensor unit further includes:

a support cradle;

a pair of bearing cages mounted on said support cradle;

a roller, mounted within said bearing cages, for contacting said free surface.

3. The device as according to claim 2, wherein said cages permit loose mounting of said roller such that said roller may rock about an axis parallel to said packaging direction and thereby adapt to the geometric configuration of said free surface of said sheet pack.

4. The device according to claim 3, wherein said blade is flat and includes a tapered free end, said device further comprising a horizontal rod for supporting said blade for horizontal movement with respect to said support cradle, and a first vertical rod, attached to said horizontal rod, for supporting the blade with respect thereto, said drive means further comprising a horizontal piston for moving said blade with respect to said support cradle.

5. The device according to claim 4, wherein said cradle includes a vertical wall to which said horizontal rod and said first horizontal piston are connected, and a horizontal surface fixed to said vertical wall and disposed tangentially to the circumference of said roller to engage said free surface therewith.

6. The device as according to claim 4, further comprising adjustment means for adjusting the vertical position of said blade with respect to said sensor unit to define a thickness of said ream.

7. The device according to claim 6, wherein said adjustment means comprises a second vertical rod attached to said first vertical rod for sliding movement with respect thereto and a handle for locking the position of said second vertical rod with respect to said first vertical rod.

8. The device according to claim 4, wherein said drive means comprises a second piston, for pivoting said support cradle with respect to said transverse axis.

9. The device according to claim 8, characterized in that the said cradle includes end stop means for limiting the pivotal movement of said support cradle.

10. The according to claim 1, further comprising means for automatically controlling said drive means to position said sensor unit and said blade.

11. The device according to claim 1, further comprising means for compacting said sheet pack beneath the selected ream.

12. The device according to claim 2, wherein said blade lies along a horizontal axis which passes through the center of said roller.

13. A device for selecting a ream from a stacked pack of sheets and facilitating the insertion of a transfer blade mounted on a carriage for transferring the selected ream to a packaging station, the device comprising:

a plate to be mounted for vertical movement with respect to the carriage;

a support cradle pivotally mounted to the plate and including a sensor unit for contacting a free surface of the sheet pack;

a ream selection blade, movably mounted with respect to the support cradle;

drive means for moving the blade with respect to the support cradle and for pivoting the support cradle with respect to the plate such that the blade first moves horizontally to penetrate the pack and then moves to an angled position with respect to the horizontal, thereby lifting an edge of the ream from the pack to permit insertion of the transfer blades.

14. The device according to claim 13, wherein the sensor unit further comprises a roller mounted on the support cradle for contacting the free surface.

15. The device as according to claim 14, wherein the roller is mounted for rocking movement about an axis parallel to the free surface to thereby adapt to the geometric configuration of the free surface of the sheet pack.

16. The device according to claim 14, wherein the support cradle includes a horizontal surface extending from the plate which is disposed tangentially to a surface of the roller to engage the free surface therewith.

17. The device according to claim 14, further comprising means for adjusting the position of the blade with respect to the sensor unit to define a thickness of the ream.

18. The device according to claim 14, wherein the cradle includes end stop means for limiting the pivotal movement of the support cradle.

19. The device according to claim 14, further comprising means for compacting the sheet pack beneath the selected ream.

20. A device for selecting a ream from a stacked pack of sheets comprising:

a surface for supporting the pack and moving said pack along a vertical axis;

a packaging station, adjacent the surface, for packaging the selected ream;

means for transferring said selected ream in a feed direction from said surface to the packaging station, the means for transferring being vertically adjustable and mounted on a horizontally movable carriage;

means for selecting the ream, including:

a plate to be mounted for vertical movement with respect to the carriage;

a support cradle pivotally mounted to the plate and including a sensor unit for contacting a free surface of the sheet pack;

a ream selection blade, movably mounted with respect to the support cradle;

drive means for moving the blade with respect to the support cradle and for pivoting the support cradle with respect to the plate such that the blade first moves horizontally to penetrate the pack and then moves to an angled position with respect to the horizontal, thereby lifting an edge of the ream from the pack to permit insertion of the transfer blades.

* * * * *